US012129107B2

(12) United States Patent
Vance et al.

(10) Patent No.: US 12,129,107 B2
(45) Date of Patent: Oct. 29, 2024

(54) FLOATING ROOF SEAL AND RELATED METHODS

(71) Applicant: Mesa Industries, Inc., Cincinnati, OH (US)

(72) Inventors: Adam K. Vance, Cincinnati, OH (US); Andrew Widjaja, Springboro, OH (US); Marcus A. Patrick, Loveland, OH (US); Matthew R. Woodruff, Hebron, KY (US)

(73) Assignee: Mesa Industries, Inc., Cincinnati, OH (US)

( * ) Notice: Subject to any disclaimer, the term of this patent is extended or adjusted under 35 U.S.C. 154(b) by 221 days.

(21) Appl. No.: 17/872,189

(22) Filed: Jul. 25, 2022

(65) Prior Publication Data

US 2023/0027282 A1 Jan. 26, 2023

Related U.S. Application Data

(60) Provisional application No. 63/225,732, filed on Jul. 26, 2021.

(51) Int. Cl.
*B65D 88/46* (2006.01)
*B65D 88/42* (2006.01)

(52) U.S. Cl.
CPC ..... *B65D 88/46* (2013.01); *B65D 88/42* (2013.01)

(58) Field of Classification Search
CPC ..... B65D 88/46; B65D 88/42; F16J 15/02
USPC ..... 220/224, 222, 221, 216; 277/422, 411, 277/409
See application file for complete search history.

(56) References Cited

U.S. PATENT DOCUMENTS

| | | | |
|---|---|---|---|
| 1,979,657 | A | 11/1934 | Wiggins |
| 1,992,221 | A | 2/1935 | Kramer |
| 2,082,194 | A | 6/1937 | Wiggins |
| 2,302,904 | A | 11/1942 | Wiggins |
| 2,314,805 | A | 3/1943 | Wiggins |
| 2,318,134 | A | 5/1943 | Wiggins |
| 2,318,135 | A | 5/1943 | Wiggins |
| 2,354,629 | A | 7/1944 | Wiggins |
| 2,427,171 | A | 9/1947 | Wiggins |
| 2,464,804 | A | 3/1949 | Goldsby et al. |

(Continued)

OTHER PUBLICATIONS

International Search Report and Written Opinion dated Nov. 28, 2022 for Application No. PCT/US22/38136, 14 pages.

*Primary Examiner* — Robert J Hicks
*Assistant Examiner* — Sanjidul Islam
(74) *Attorney, Agent, or Firm* — Frost Brown Todd LLP

(57) ABSTRACT

A storage system for a petroleum product and related methods includes a floating roof seal having a vapor barrier and a coupling assembly. The coupling assembly includes a barrier securement and a shoe mount bracket for securing to a shoe plate. The barrier securement has a securement body and a resilient portion biased toward a clamp position and configured to selectively deflect relative to the securement body from the clamp position to an installation position. The barrier securement with the resilient portion in the installation position is configured to be received on the shoe mount bracket such that the barrier portion is positioned between the barrier securement and the shoe mount bracket. The barrier securement with the resilient portion in the clamp position is configured to compress the barrier portion against the shoe mount bracket thereby fluidly sealing the barrier portion between the shoe mount bracket and the barrier securement.

17 Claims, 12 Drawing Sheets

(56) References Cited

U.S. PATENT DOCUMENTS

| | | | |
|---|---|---|---|
| 2,568,529 | A | 9/1951 | Wiggins |
| 2,568,728 | A | 9/1951 | Goldsby et al. |
| 2,586,813 | A | 2/1952 | Goldsby et al. |
| 3,019,935 | A | 2/1962 | Anderson, Sr. |
| 4,371,090 | A | 2/1983 | Ogarek et al. |
| 5,137,167 | A | 8/1992 | Ploeger |
| 5,667,091 | A | 9/1997 | Slaber, Jr. et al. |
| 5,927,534 | A | 7/1999 | King et al. |
| 6,164,479 | A | 12/2000 | Kern |
| 6,247,607 | B1 | 6/2001 | King |
| 7,044,322 | B2 | 5/2006 | Owens et al. |
| 8,727,161 | B2 | 5/2014 | Rosenkrantz |
| 2009/0266817 | A1 | 10/2009 | Hilliard, Jr. et al. |
| 2016/0031637 | A1 | 2/2016 | Bretherton |

FLOATING ROOF SEAL AND RELATED METHODS

CROSS-REFERENCE TO RELATED APPLICATION

This application claims priority to U.S. Pat. App. No. 63/225,732, filed on Jul. 26, 2021, entitled "Floating Roof Seal and Related Methods," the disclosure of which is hereby expressly incorporated by reference herein, in its entirety.

TECHNICAL FIELD

The present invention relates generally to a storage tank with a floating roof and related methods and, more particularly, to a storage tank with a floating roof for storing a petroleum product.

BACKGROUND

Storage systems for a petroleum product, such as crude oil and petrochemicals, generally contain large quantities of fluid, including liquid and gas, at various volumes as this petroleum product is added and/or removed from a storage tank during use. In at least some instances, such storage tanks are fitted with a floating roof configured to rise and fall with the adjusting volumes of the petroleum product contained within the storage tank in order to reduce material loss associated with tank breathing and similarly reduce evaporative loss of the petroleum product while in storage. A floating roof seal may thus be incorporated between the floating roof and a wall of the storage tank for further sealing and containing the petroleum product within the storage tank. More particularly, a floating roof seal in one example includes a vapor barrier fabric that effectively accommodates movement of the floating roof for improved sealing between the floating roof and the wall of the storage tank.

Due to the harsh environment created at least in part by the petroleum product as well as the desire for durable and effective sealing between the floating roof and the wall of the storage tank, technicians may install thousands of fasteners directly through the vapor barrier fabric in order to effectively secure and seal the vapor barrier fabric in place. Tight clearance in one or more areas around the vapor barrier fabric inhibits the technician's access during installation and, in turn, increases time to build the storage system to full capability and use. Moreover, these fasteners extending directly through the vapor barrier fabric create added stress concentrations in the vapor barrier fabric with any associated holes further weakening the vapor barrier fabric, thereby increasing the likelihood of greater vapor leakage and ultimately premature failure of the vapor barrier fabric.

Accordingly, there is a need for a storage system with a floating roof seal that addresses the present challenges such as those discussed above.

BRIEF DESCRIPTION OF THE DRAWINGS

While the specification concludes with claims which particularly point out and distinctly claim this technology, it is believed this technology will be better understood from the following description of certain examples taken in conjunction with the accompanying drawings, in which like reference numerals identify the same elements and in which:

Figure 1:
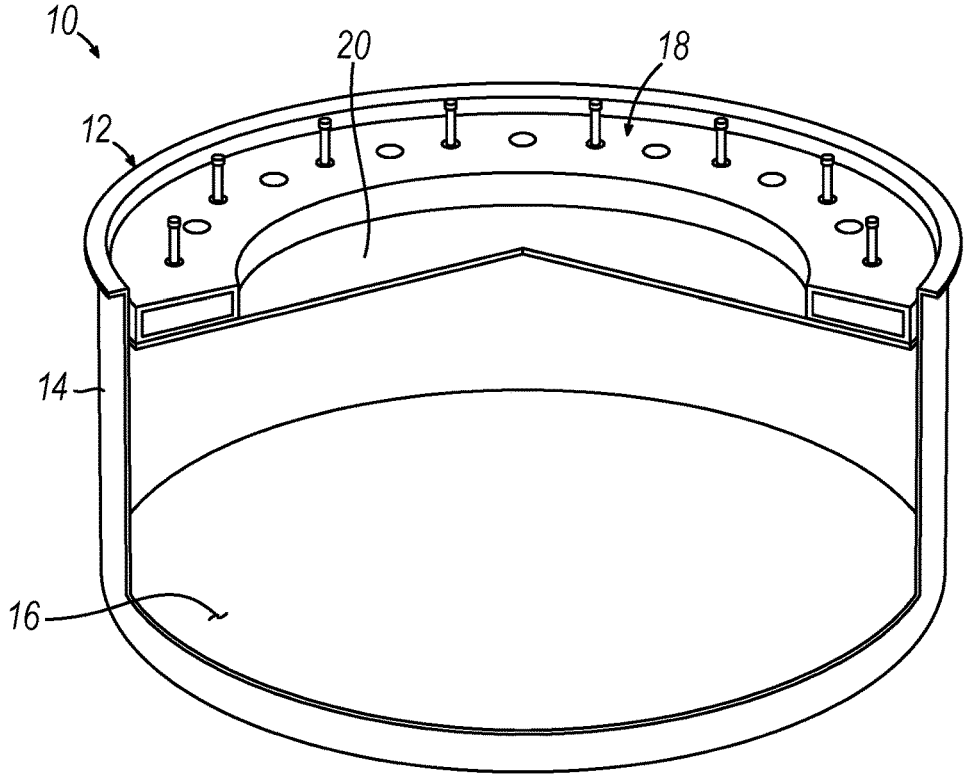
FIG. 1 depicts a perspective sectional view of an example of a storage system for storing a petroleum product including a storage tank with an exemplary floating roof system including floating roof and an exemplary floating roof seal.

The drawings are not intended to be limiting in any way, and it is contemplated that various embodiments of the technology may be carried out in a variety of other ways, including those not necessarily depicted in the drawings. The accompanying drawings incorporated in and forming a part of the specification illustrate several aspects of the present technology, and together with the description serve to explain the principles of the technology; it being understood, however, that this technology is not limited to the precise arrangements shown.

DETAILED DESCRIPTION

The following description of certain examples of the technology should not be used to limit its scope. Other examples, features, aspects, embodiments, and advantages of the technology will become apparent to those skilled in the art from the following description, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

It is further understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

For clarity of disclosure, the terms "vertical," "horizontal," and "radial" are defined herein relative to a circular storage tank positioned on a ground surface. In this respect, "lower vertical direction" is toward to the ground, "upper vertical direction" is away from the ground, "left horizontal direction" is circumferentially left parallel to the ground, "right horizontal direction" is circumferentially right parallel to the ground, and "radial direction" is toward or away from an outer wall of the storage tank relative to a central axis of the storage tank. It will be further appreciated that, for convenience and clarity, spatial terms such as "upper," "lower," "lateral," "inner," "outer," "leftward," "rightward," and "central" also are used herein for reference to relative positions and directions. Such terms are used below with reference to views as illustrated for clarity and are not intended to limit the invention described herein.

Aspects of the present examples described herein may be integrated into a storage system for a petroleum product, such as such as crude oil, which may also be referred to herein as petroleum, refined petroleum, which may also be referred to herein as petrochemicals, and generally any volatile, flammable chemical with a low vapor pressure. More broadly, such aspects may be incorporated into any such storage system including a floating roof for fluidly sealing the floating roof to a tank wall. As used herein the term "fluidly sealing" and "sealing" refers to a sufficient seal for storing petrochemicals as will be appreciated by one of ordinary skill in the art. At least some leakage of vapor, such as petrochemical related vapors, may occur in use and still be considered "fluidly sealed" and "sealed" for the purpose of the examples described below and integrated into an exemplary storage system. The invention is thus not intended to be unnecessary limited to a complete, perfect fluid seal being formed by a floating roof seal nor should the invention be unnecessarily limited to use with petroleum products.

I. Exemplary Storage System for a Petroleum Product

FIG. 1 shows an example of a storage system (10) including a storage tank (12) having a tank wall (14), a tank floor (16), and an exemplary floating roof system (18) suspended above tank floor (16) for storing a petroleum product within storage tank (12). Tank wall (14) extends in a vertical direction upward from tank floor (16) and is generally circular in the present example, although alternative shapes and sizes may differ from storage tank (12) in other examples. Floating roof system (18) is sized and shaped to accommodate tank wall (14) while sufficiently sealing the petroleum product, particularly associated vapors, within the storage tank (12) to accommodate local regulations while accommodating vertical movement of floating roof system (18) resulting from differing amounts of petroleum product and environmental changes during use. To this end, floating roof system (18) has a floating roof (20) and an exemplary floating roof seal (22), which extends between floating roof (20) and an inner surface of tank wall (14), for sufficient sealing therebetween.

Figure 2:
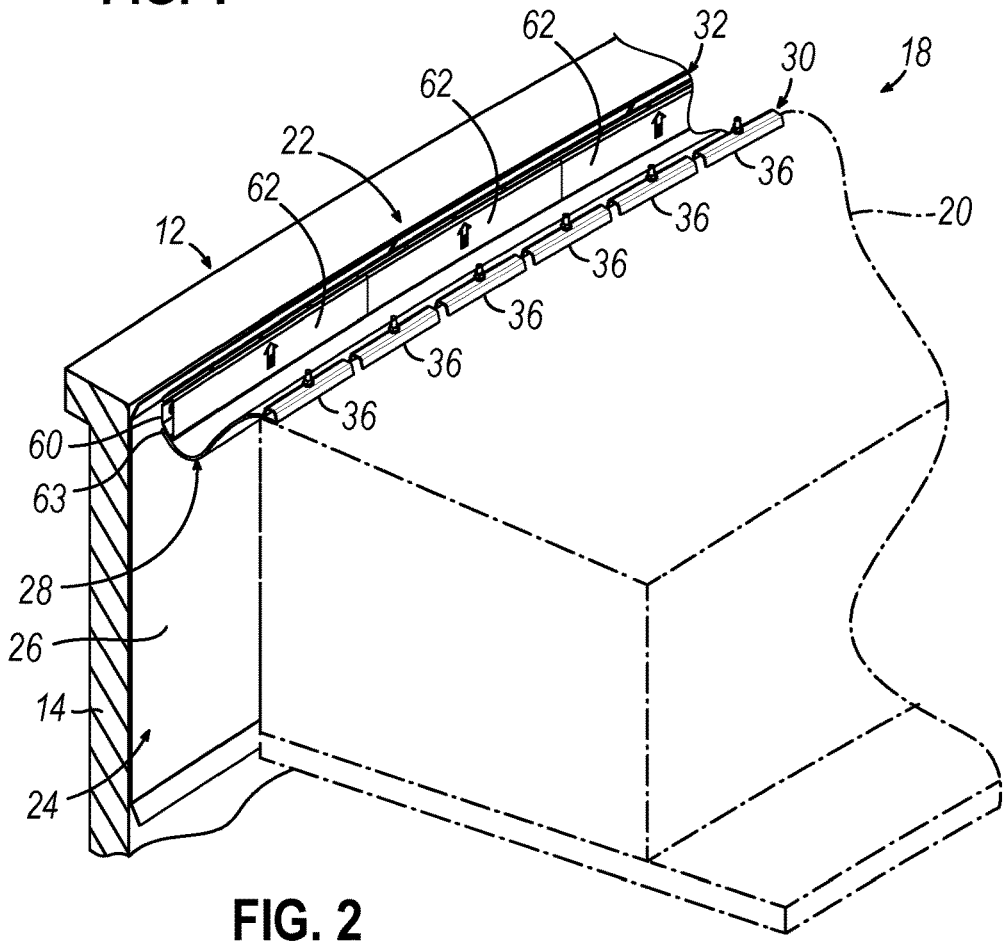
FIG. 2 depicts an enlarged perspective view of the floating roof seal of FIG. 1.

As shown more particularly in FIG. 2, floating roof seal (22) includes a circumferential shoe assembly (24) of a plurality of shoes (26) configured to engage the inner surface of tank wall (14) thereby forming a primary seal between tank wall (14) and shoe assembly (24). Floating roof seal (22) further includes a vapor barrier fabric (28) extending radially between floating roof (20) and shoe assembly (24) thereby forming a barrier seal configured to inhibit leakage of petroleum product upward between shoes (26) and floating roof (20). While vapor barrier fabric (28) may be manufactured from a plurality of woven materials, such as fibers, the invention is not intended to be unnecessarily limited to such fabric. Rather, any vapor barrier that is generally flexible and thus configured to accommodate relative movement between shoe assembly (24) and floating roof (20) may be similarly used.

An inner coupling assembly (30) of floating roof seal (22) secures vapor barrier fabric (28) to floating roof (20), whereas an outer coupling assembly (32) of floating roof seal (22) secures vapor barrier fabric (28) to shoe assembly (24). More particularly, outer coupling assembly (32) circumferentially holds vapor barrier fabric (28) resiliently in compression as discussed below such that no fasteners extend through vapor barrier fabric (28), thereby simplifying installation and removal of vapor barrier fabric (28) by a technician while also improving sealing capabilities for increased fluid seal therebetween that similarly reduces the deleterious impact of at least a portion of petroleum product otherwise being released into a surrounding environment.

While the following discusses aspects of floating roof seal (22) in greater detail with respect to planar arrangements of one or more shoes (26) and corresponding sections of floating roof seal (22), it will be appreciated that these arrangements may be successively repeated, positioned alongside each other, and curved to accommodate an inner curvature of tank wall (14). Thus, the present example of outer coupling assembly (32) is free of fasteners extending through an entire circumferential edge portion of vapor barrier fabric (28) such that no holes extend through this entire circumferential edge portion of vapor barrier fabric (28). Alternatively, some fasteners may be used in other examples through vapor barrier fabric (28) such that the invention is not intended to be unnecessarily limited to only being free of such fasteners and/or holes extending therethrough. Furthermore, one or more aspects of outer coupling assembly (32) may be similarly incorporated into inner coupling assembly (30) such that at least some portions of inner coupling assembly (30) may alternatively or additionally clamp against vapor barrier fabric (28) without fasteners and/or holes extending through vapor barrier fabric (28). The invention is thus not intended to be unnecessarily limited to the particular outer coupling assembly (32) and/or inner coupling assembly (30) shown and described herein.

A. Exemplary Barrier Securements

Figure 3:
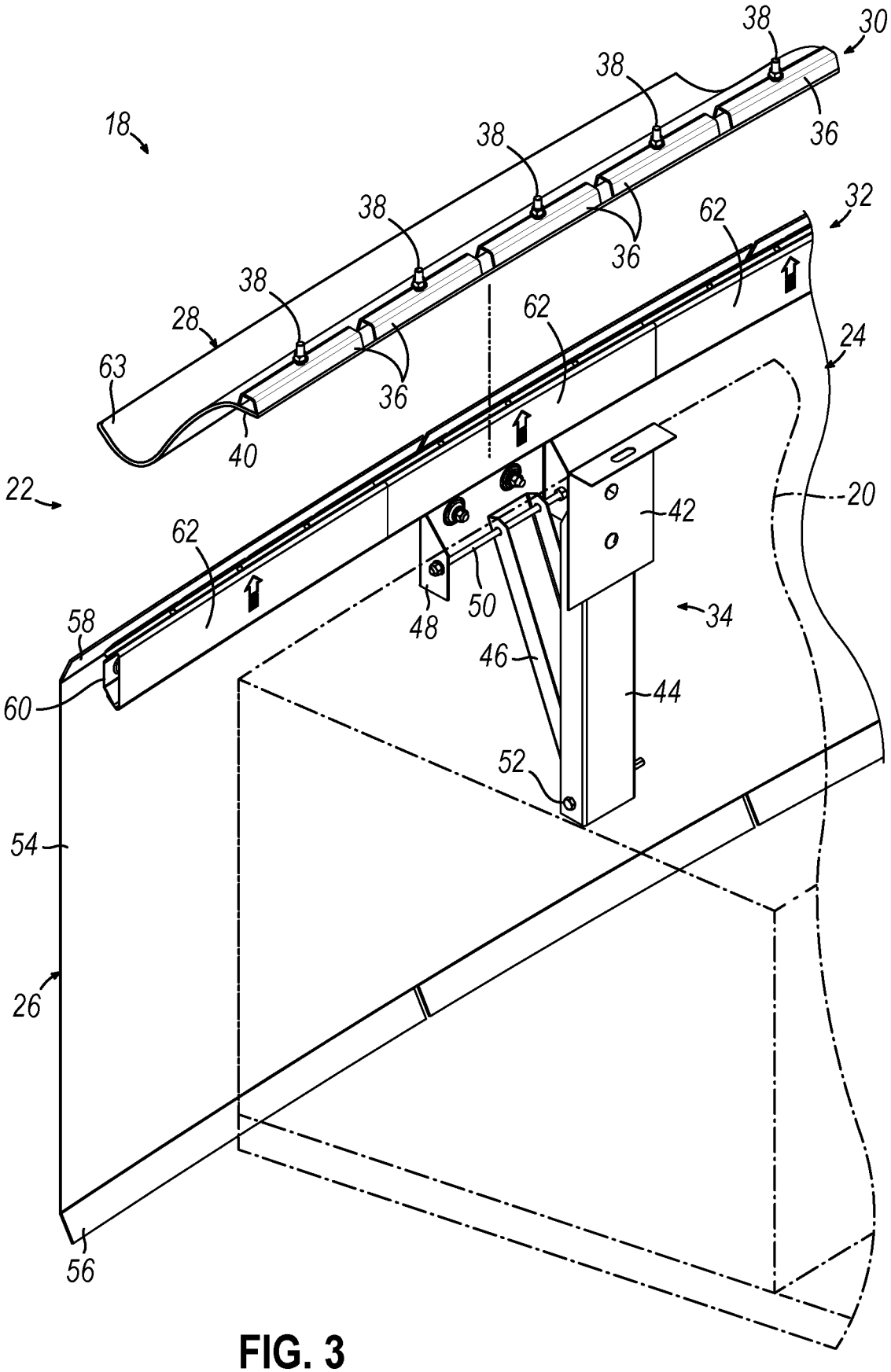
FIG. 3 depicts an enlarged, partially exploded, perspective view of the floating roof seal of FIG. 1 including a shoe, a vapor barrier fabric, an outer coupling assembly for connecting the vapor barrier fabric to the shoe, and an inner coupling assembly for connecting the vapor barrier fabric to the floating roof.
Figure 4:
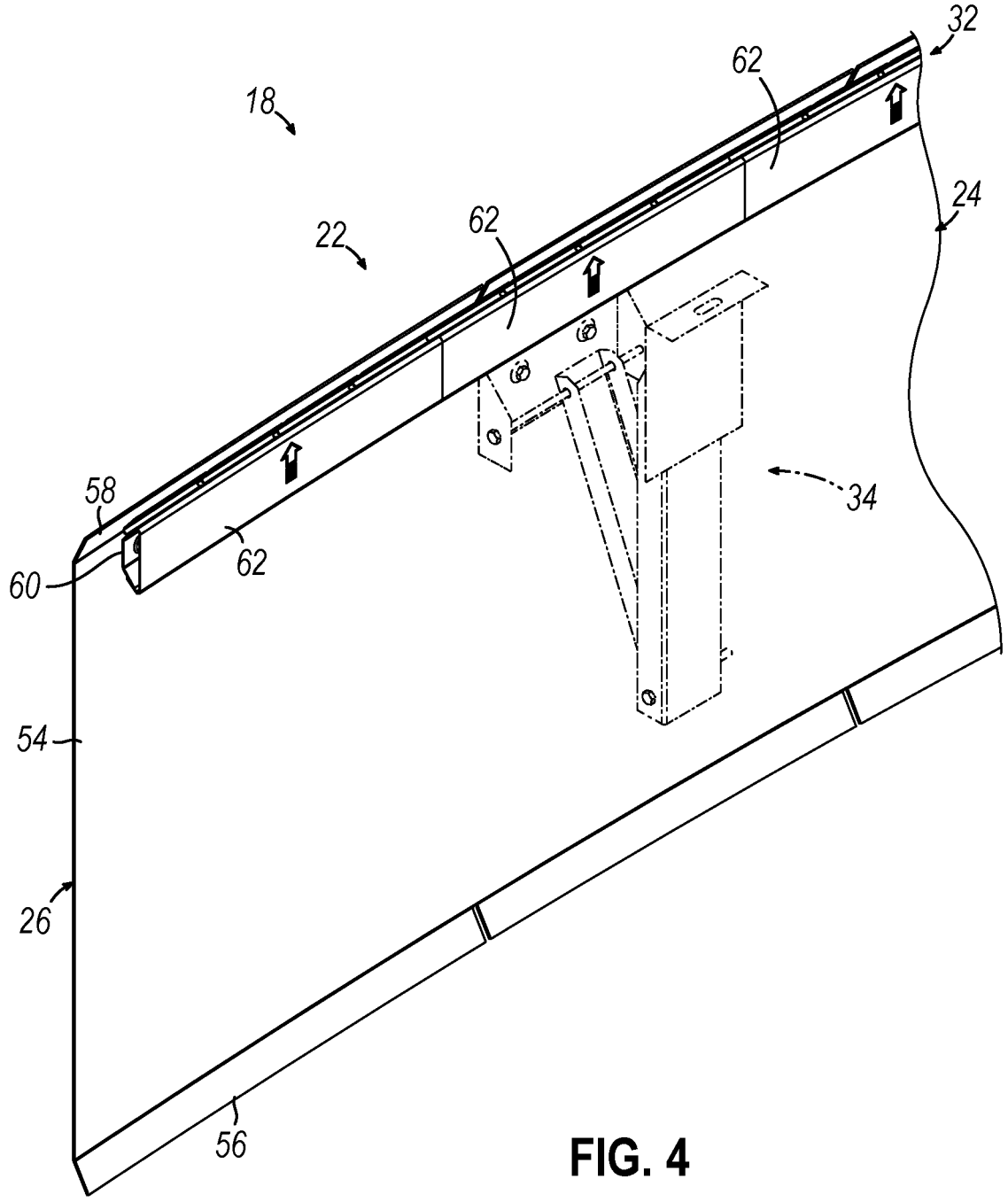
FIG. 4 depicts an enlarged perspective view of the shoe and the outer coupling assembly of FIG. 3.

As shown in FIGS. 3-4, floating roof seal (22) includes inner coupling assembly (30) for securing vapor barrier fabric (28) to floating roof (20) as discussed briefly above as well as a plurality of hangers (34) for movably attaching respective shoes (26) to floating roof (20). With respect to securement of vapor barrier fabric (28), inner coupling assembly (30) includes a plurality of clamp brackets (36) and a plurality of respective fasteners (38). Each clamp bracket (36) of the present example has a generally U-shaped cross-section and is positioned directly against an inner edge portion (40) of vapor barrier fabric (28) thereby compressing inner edge portion (40) against floating roof (20). Each fastener (38) extends through each of clamp bracket (36), inner edge portion (40), and floating roof (20) thereby securing vapor barrier fabric (28) directly to floating roof (20) for a sufficient fluid seal therebetween.

With respect to attachment of shoes (26), each hanger (34) includes a hanger roof mount (42), a hanger base bracket (44), a hanger actuation bracket (46), and a hanger shoe mount (48). Hanger actuation bracket (46) is pivotally connected to each of hanger shoe mount (48) and hanger base bracket (44) via a mount pin (50) and a bracket pin (52), respectively. Thus, as floating roof (20) shifts horizontally during use, hangers (34) both suspend shoe assembly (24) from floating roof (20) and allow local horizontal and radial expansion and contraction such that each shoe (26) remains engaged with the inner surface of tank wall (14) (see FIG. 2). Additionally, in the present example, each hanger actuation bracket (46) is biased from a contracted state toward an expanded state, such as via a biasing element (not shown), to urge each shoe (26) radially outward toward tank wall (14) (see FIG. 2) and collectively center floating roof (20) within tank wall (14) thus accommodating movement while maintaining the seal between shoe (26) tank wall (14) (see FIG. 2).

To this end, each shoe (26) more particularly includes a shoe plate (54), a lower shoe flange (56) extending downward from shoe plate (54), and an upper shoe flange (58) extending upward from shoe plate (54). While shoe plate (54) extends generally in a vertical direction so as to extend parallel in engagement with tank wall (14) (see FIG. 2) for sealing there between, each of lower and upper shoe flanges (56, 58) also extends at a radially inward angle. Lower and upper shoe flanges (56, 58) thereby guide vertical movement of shoe plate (54) during use so as to inhibit shoe plate (54) from becoming wedged or otherwise seized against tank wall (14) (see FIG. 2). As used herein, it will be appreciated that the term "shoe" as it relates to any components of shoe assembly (24) is not intended to unnecessarily limit the invention described herein.

Vapor barrier fabric (28) also extends from floating roof (20) for securement to shoe assembly (24) via outer coupling assembly (32) as discussed briefly above. More particularly, outer coupling assembly (32) includes a plurality of shoe mount brackets (60) and a plurality of exemplary barrier securements (62), each of which is more specifically is a barrier securement clip (62) in the present example. With respect to each shoe (26), barrier securement clip (62) is configured releasably couple with shoe mount bracket (60) to compress an outer edge portion (63) of vapor barrier fabric (28) therebetween in order to secure vapor barrier fabric (28) to shoe plate (54) and further form the fluid seal with vapor barrier fabric (28).

Figure 5:
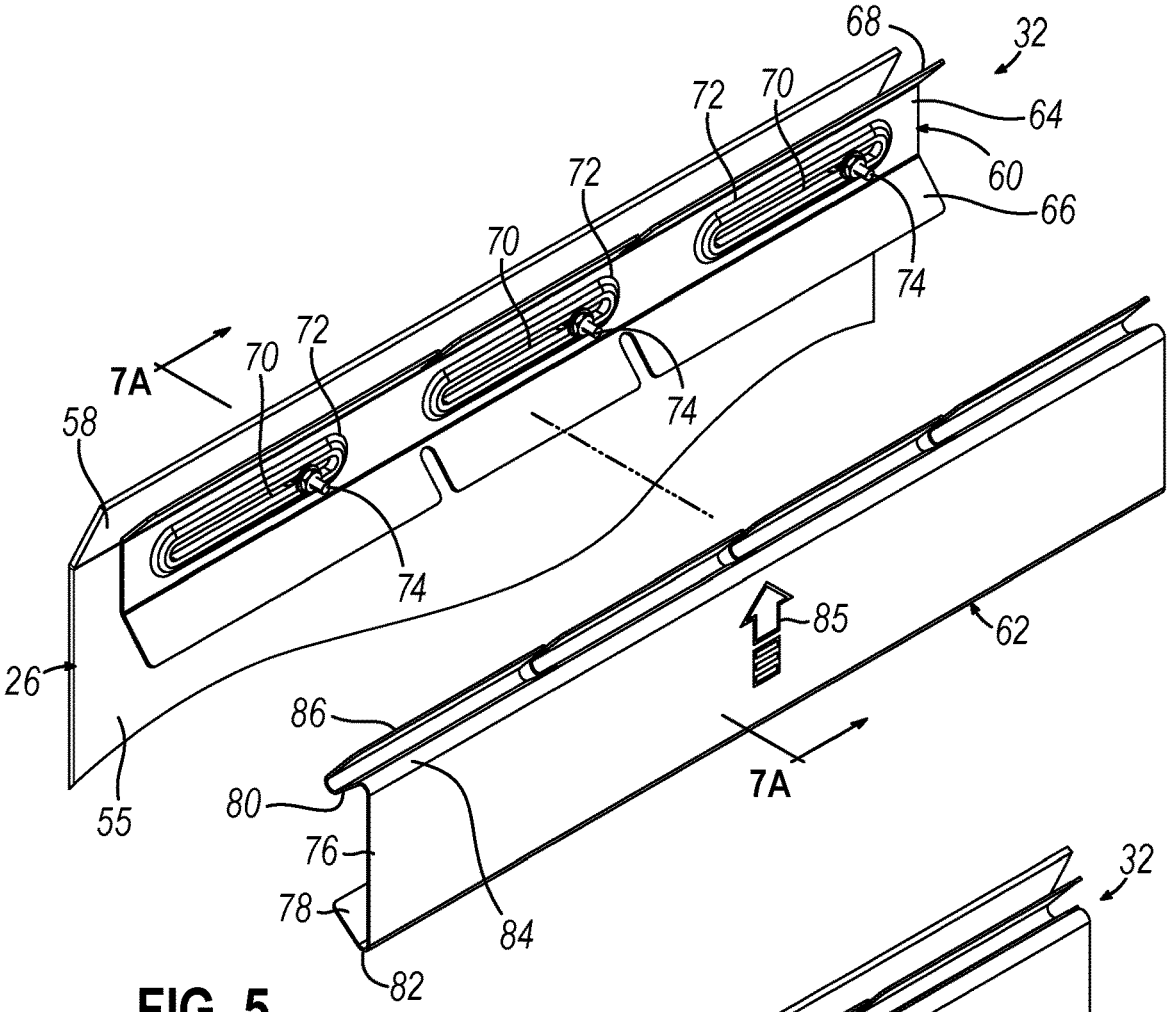
FIG. 5 depicts an enlarged perspective view of the outer coupling assembly of FIG. 3 with a shoe mount bracket and an exemplary barrier securement clip in a disassembled state.
Figure 6:
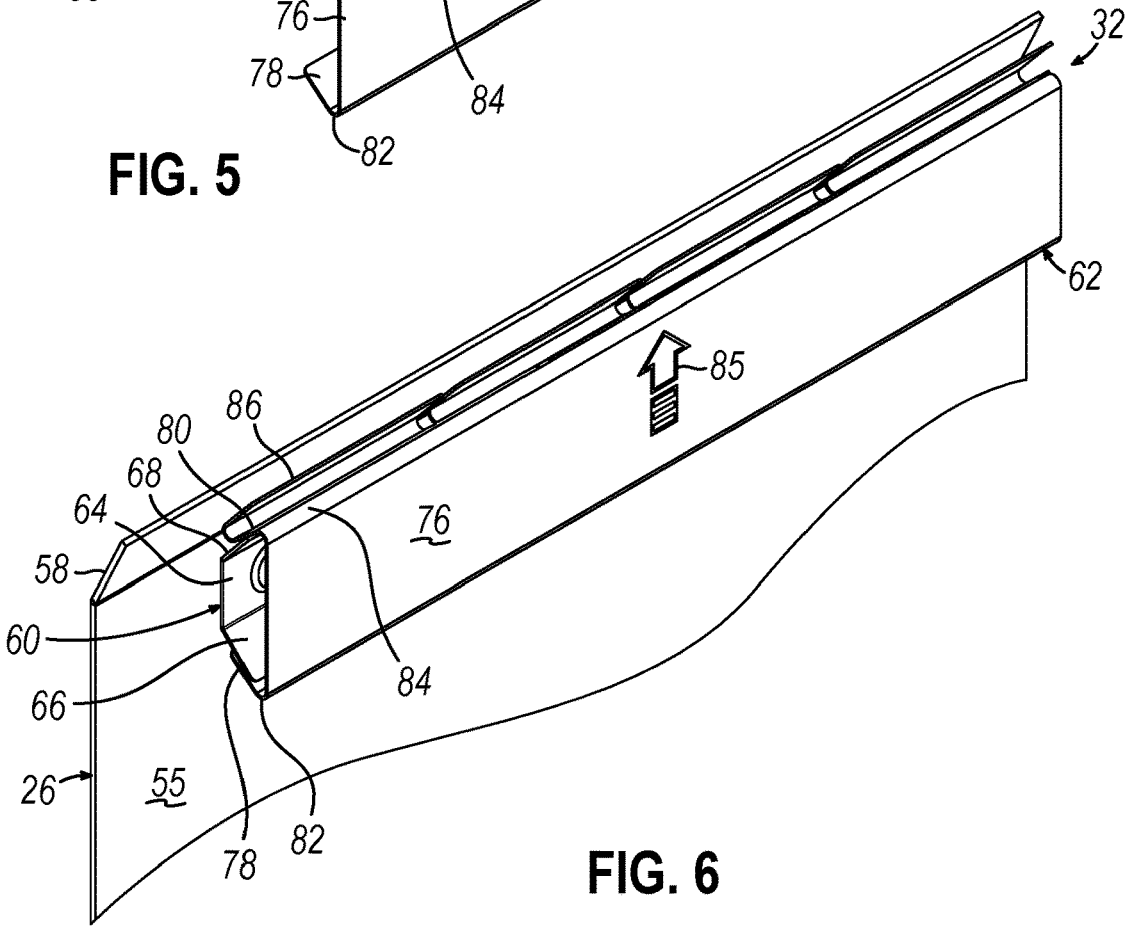
FIG. 6 depicts an enlarged perspective view of the outer coupling assembly of FIG. 5 with the shoe mount bracket and the barrier securement clip in an assembled state.

With respect to FIGS. 5-6, shoe mount bracket (60) of the present example further includes a base plate (64), a lower lip (66), and an upper lip (68). Base plate (64) extends generally in the vertical direction, whereas lower lip (66) extends downward therefrom and radially inward at an angle relative to base plate (64) toward barrier securement clip (62). In contrast, upper lip (66) extends upward from base plate (64), but also radially inward at an angle relative to base plate (64) toward barrier securement clip (62). In the present example, lower and upper lips (66, 68) are in the form of flanges extending along base plate (64). Furthermore, base plate (64) has a plurality of elongate holes (70) respectively surrounded by elongate bosses (72) receiving a plurality of fasteners (74) for affixing shoe mount bracket (60) directly to shoe (26) although it will be appreciated that any features configured to affix shoe mount bracket (60) relative to shoe (26) may be similarly used. Alternatively, shoe mount bracket (60) may be unitarily and integrally formed with shoe (26) in another example. Shoe mount bracket (60) is thus not intended to be unnecessarily limited to the particular example shown and described herein.

Whereas shoe mount bracket (60) has fasteners (74) extending therethrough, barrier securement clip (62) of the present example is free of fasteners extending therethrough and configured to releasably affix to shoe mount bracket (60) by resiliently clipping onto shoe mount bracket (60). Specifically, barrier securement clip (62) has a clip plate (76), a lower barrier catch (78), and an upper barrier catch (80). Clip plate (76) extends generally in the vertical direction, whereas lower barrier catch (78) extends downward therefrom and radially outward at an angle relative to clip plate (76) toward base plate (64). In contrast, upper barrier catch (80) extends upward from clip plate (76), but also radially outward at an angle relative to clip plate (76) toward base plate (64). In the present example, lower and upper barrier catches (78, 80) are in the form of flanges extending along clip plate (76). Each clip plate (76) has a plurality of such lower barrier catches (78) at least partially separated by gaps. Similarly, each clip plate (76) has a plurality of such upper barrier catches (80) at least partially separated by gaps. Such gaps may provide for greater deflection and/or flexibility along barrier securement clip (62) for ease of installation and/or removal from shoe mount bracket (60). Alternative examples of barrier securement clip (62) may be free of such gaps, such that the invention is not intended to be unnecessarily limited to the particular arrangement of lower and upper barrier catches (78, 80) as shown and described herein.

Lower and upper barrier catches (78, 80) extend from clip plate (76) and are resiliently biased relative to clip plate (76) to a clamp position as shown in FIGS. 5-7A. To this end, barrier securement clip (62) of the present example further includes a lower resilient portion (82) extending at least partially between lower barrier catch (78) and clip plate (76) as well as an upper resilient portion (84) extending at least partially between upper barrier catch (80) and clip plate (76). Lower and upper barrier catches (78, 80) are thus each configured to deflect relative to clip plate (76) from respective clamp positions to unclamped positions, which may also be referred to herein as installation positions. In this respect either one or both of lower and upper barrier catches (78, 80) deflected to the unclamped position effectively increases an open distance between lower and upper barrier catches (78, 80) so that each of lower and upper barrier catches (78, 80) sufficiently clears lower and upper lips (66, 68) of shoe mount bracket (60) for being received on shoe mount bracket (60) or removed from shoe mount bracket (60).

In addition, barrier securement clip (62) of the present example further includes a grip tab (86) extending upward and radially inward from upper barrier catch (78). Grip tab (86) is configured to be selectively manipulated by a technician to generate a moment about upper resilient portion (84) to deflect upper resilient portion (84) and thereby selectively move upper barrier catch (80) from the clamp position toward the unclamped, installation position. Alternatively or in addition, another grip tab (86) may similarly extend from lower barrier catch (78) for similar manipulation. The invention is thus not intended to be unnecessarily limited to the particular grip tab (86) shown in the present example. An arrow (85) may also be included on barrier securement clip (62) to indicate an upward and desired direction of installation for such lower and upper directions, although it will be appreciated that arrow (85) may not be included in one or more examples.

Figure 7C:
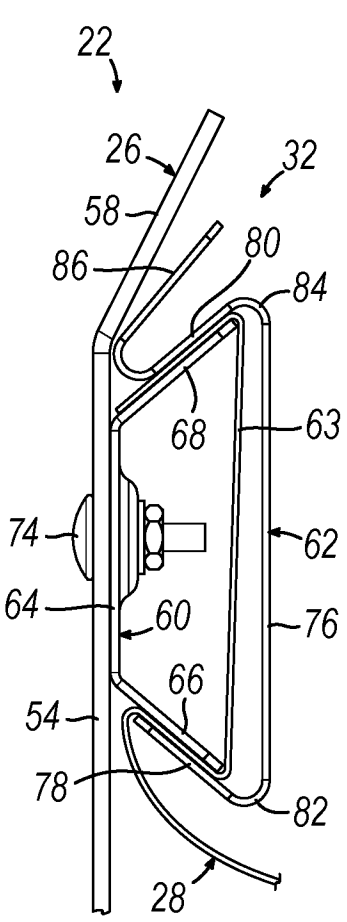
FIG. 7C depicts a cross-sectional view of the outer coupling assembly similar to FIG. 7B, but showing the resilient portion of the barrier securement clip selectively released from the installation position to a clamp position for securing the vapor barrier fabric to the shoe.
Figure 7B:
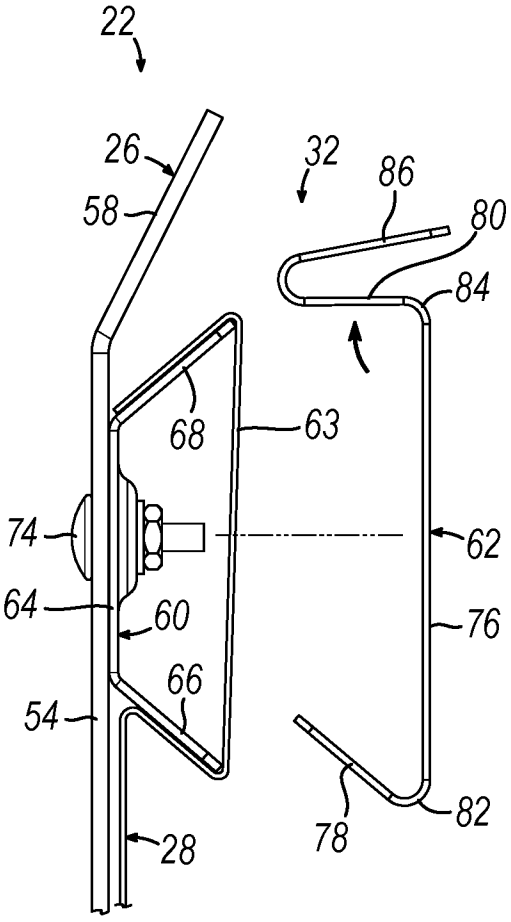
FIG. 7B depicts a cross-sectional view of the outer coupling assembly similar to FIG. 7A, but showing a resilient portion of the barrier securement clip selectively deflected to an installation position for being received on the shoe mount bracket.
Figure 7A:
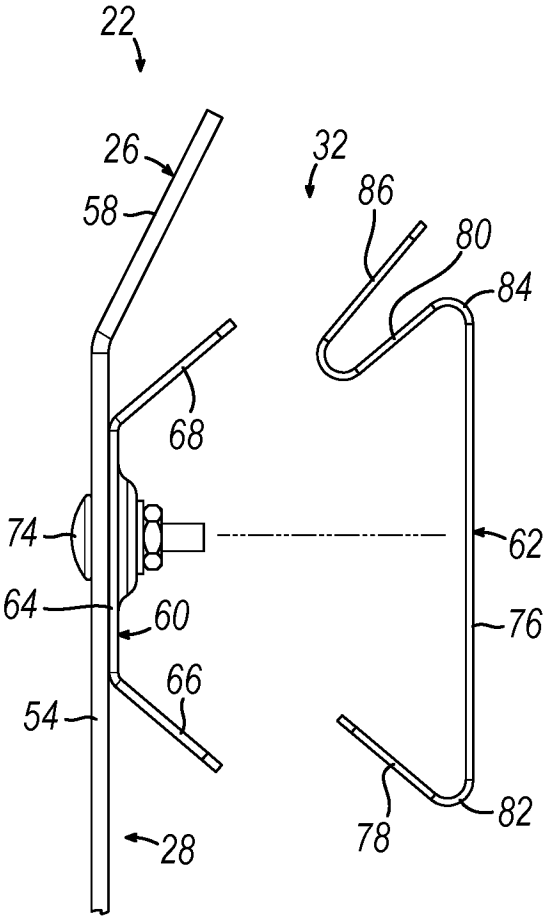
FIG. 7A depicts a cross-sectional view of the outer coupling assembly of FIG. 5 taken along section line 7A-7A of FIG. 5 with the shoe mount bracket and the barrier securement clip in the disassembled state.

In use, FIGS. 7A-7C show installation of barrier securement clip (62) onto shoe mount bracket (60) for securement of vapor barrier fabric (28) to shoe (26). Barrier securement clip (62) is brought proximate to shoe mount bracket (60) with outer edge portion (63) of vapor barrier fabric (28) positioned so as to extend over each of lower and upper lips (66, 68). Technician manipulates grip tab (86) clockwise back toward clip plate (76) so as to defect upper resilient portion (84) and move upper barrier catch (80) relative to clip plate (76) from the clamp position shown in FIG. 7A to the installation position shown in FIG. 7B. With outer edge portion (63) of vapor barrier fabric (28) positioned between barrier securement clip (62) and shoe mount bracket (60), lower barrier catch (78) is then effectively hooked around lower lip (66) and upper barrier catch (80) is moved toward upper lip (68) such that lower and upper lips (66, 68) are vertically between lower and upper barrier catches (78, 80). Technician then releases grip tab (86) to resiliently return upper barrier catch (80) to the clamp position shown in FIG. 7C such that upper barrier catch (80) resiliently compresses a portion of outer edge portion (63) of vapor barrier fabric (28) against upper lip (68) and, in turn, lower barrier catch (78) resiliently compresses another portion of outer edge portion (63) of vapor barrier fabric (28) against lower lip (66). Fluid sealing of outer edge portion (63) of vapor barrier fabric (28) is thereby formed against each of lower and upper barrier catches (78, 80), while further fluid sealing occurs between base plate (64) of shoe mount bracket (60) against shoe plate (54). Barrier securement clip (62) is sized and shaped relative to shoe mount bracket (60) such that lower and upper barrier catches (78, 80) are resiliently held in compression toward lower and upper lips (66, 68) against outer edge portion (63) of vapor barrier fabric (28) during use.

While the above description of installation of barrier securement clip (62) onto shoe mount bracket (60) applies to one such barrier securement clip (62) and shoe mount bracket (60), this method of installation may then be repeated for each additional barrier securement clip (62) and shoe mount bracket (60) about an entire circumference of outer edge portion (63) of vapor barrier fabric (28) until vapor barrier fabric (28) is attached to shoe assembly (24) as desired.

Figure 8:
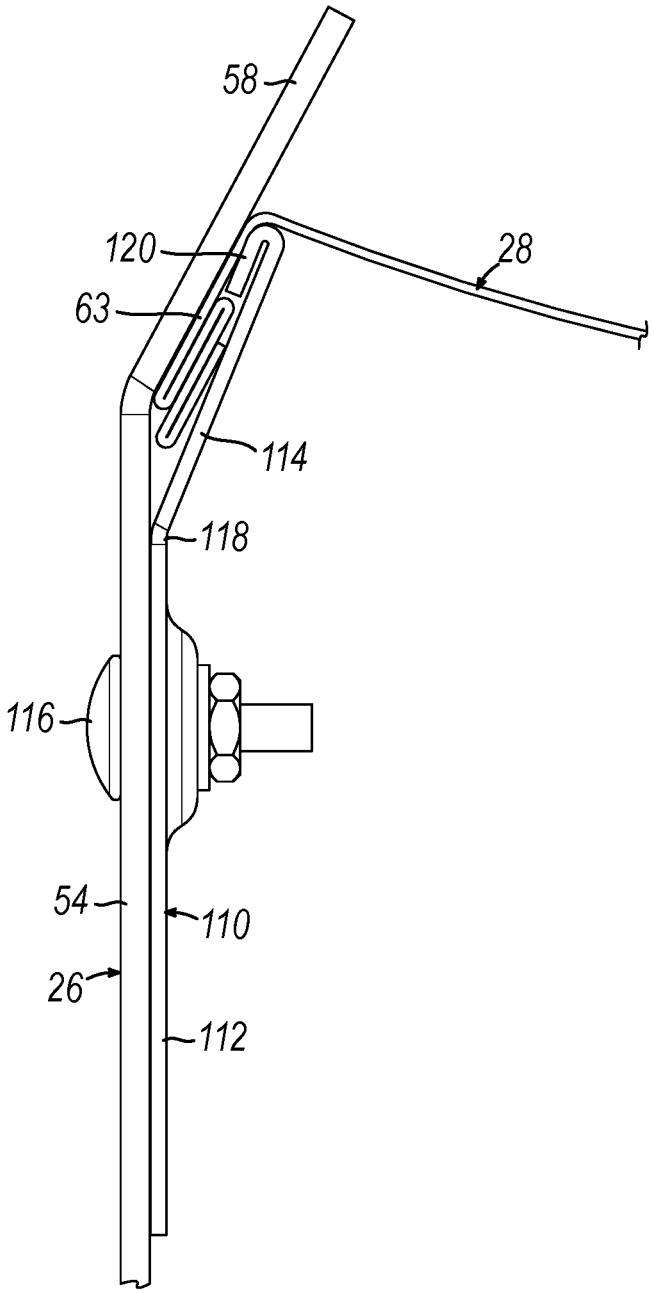
FIG. 8 depicts a side elevational view of an exemplary barrier securement wedge as an alternative for securing the vapor barrier fabric to the shoe of FIG. 3.

FIG. 8 shows an alternative exemplary barrier securement (110), which is more particularly a barrier securement wedge (110) in the present example. Barrier securement wedge (110) has a wedge base (112) and a wedge catch (114). Wedge catch (114) extends from wedge base (112), which is affixed to shoe plate (54) by at least one fastener (116), and resiliently biased relative to wedge base (112) to a clamp position. To this end, barrier securement wedge (110) of the present example further includes a resilient portion (118) extending at least partially between wedge base (112) and wedge catch (114) and configured to deflect and selectively move wedge catch (114) relative to wedge base (112) from the clamp position to an installation position for receiving or removing outer edge portion (63) of vapor barrier fabric (28).

Wedge catch (114) further includes a head (120) configured to compress outer edge portion (63) of vapor barrier fabric (28) for fluid sealing thereagainst as well as hook a remaining portion of outer edge portion (63) of vapor barrier fabric (28) for further securement of outer edge portion (63) to shoe (26). More particularly, wedge catch (114) is biased toward upper shoe flange (58) such that outer edge portion (63) of vapor barrier fabric (28) is compressed directly against and between wedge catch (114) and upper shoe flange (58).

In use, technician grips wedge catch (114) and deflects wedge catch (114) relative to wedge base (112) from the clamp position to the installation position to effectively open a space between wedge catch (114) and upper shoe flange (58). Outer edge portion (63) of vapor barrier fabric (28) is inserted through the space and wedge catch (114) is released by the technician from the installation position to the clamp position to fluidly seal and secure outer edge portion (63) of vapor barrier fabric (28) to upper shoe flange (58).

While the above description of installation of one such barrier securement wedge (110) and outer edge portion (63) of vapor barrier fabric (28) is shown in FIG. 8, this method of installation may then be repeated for each additional barrier securement wedge (110) about an entire circumference of outer edge portion (63) of vapor barrier fabric (28) until vapor barrier fabric (28) is attached to shoe assembly (24) as desired.

B. Exemplary Bridge Securements

Figure 9:
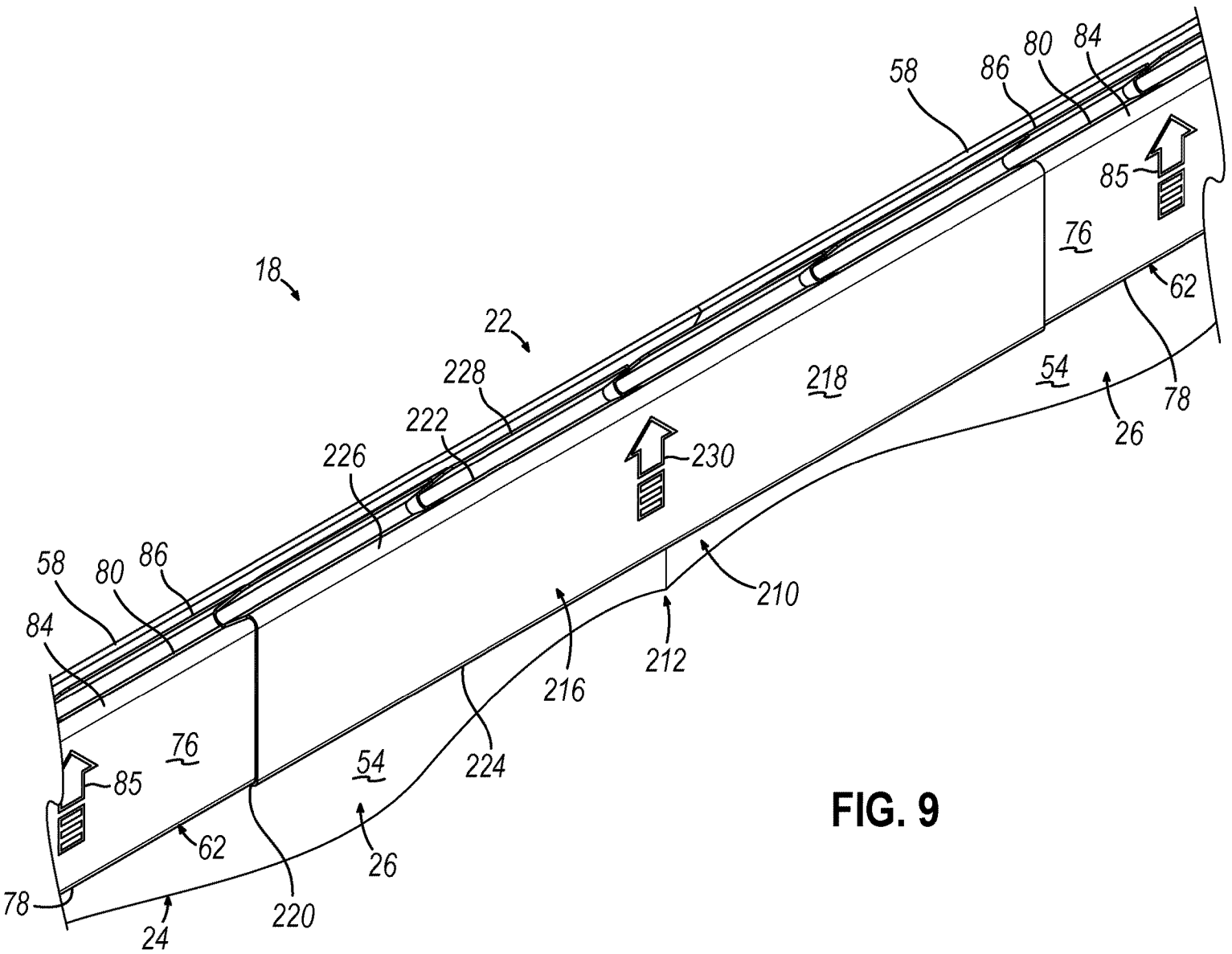
FIG. 9 depicts an enlarged perspective view of an exemplary bridge coupling of the outer coupling assembly for movably connecting a pair of shoes of FIG. 3 together at a pair of barrier securement clips of FIG. 3.
Figure 10:
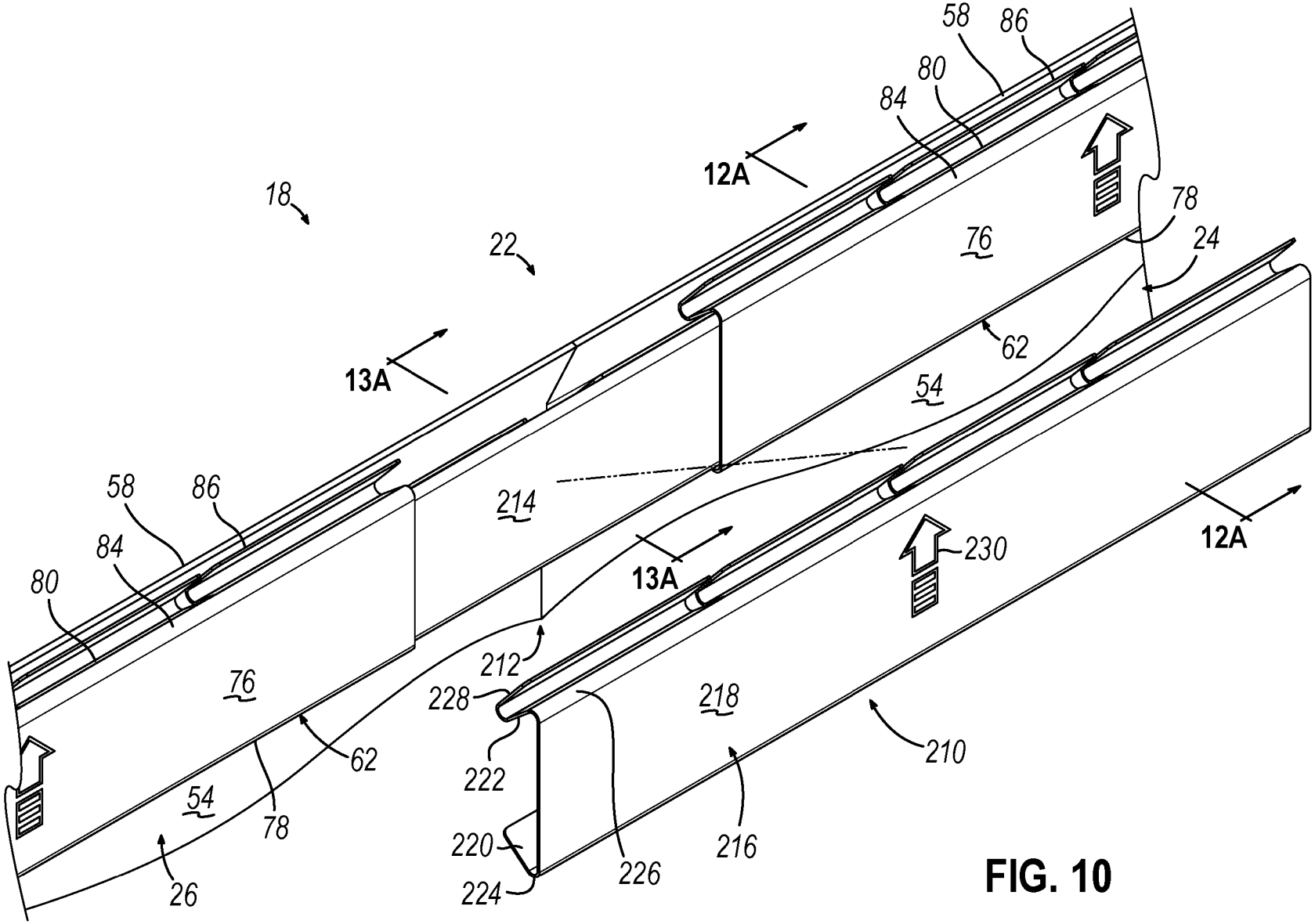
FIG. 10 depicts an enlarged, partially exploded, perspective view of the bridge coupling of FIG. 9 with the bridge coupling including a bridge securement and a bridge member such that the bridge member is received within the barrier securement clips.

While the above barrier securement clip (61) of outer coupling assembly (32) is configured to secure outer edge portion (63) of vapor barrier fabric (28) to respective shoes (26) of shoe assembly (24) as shown in FIGS. 2-7C, outer coupling assembly (32) may further include coupling features between proximate, and more particularly adjacent, shoes (26) in one or more examples for movable connection and fluid sealing. To this end, outer coupling assembly (32) further includes a plurality of exemplary bridge couplings (210) that respectively straddle an adjustable overlap (212) between each respective pair of shoes (26) to accommodate sliding of one such shoe (26) relative to another adjacent and overlapping shoe (26) without binding during use. One such pair of shoes (26) connected via with bridge coupling (210) straddling adjustable overlap (212) is shown in FIGS. 9-10, although it will be appreciated that additional pairs of shoes (26) and adjustable overlaps (212) are angularly positioned about a circumference of outer coupling assembly (32). As used herein, this "overlap" refers to a portion of one such shoe (26) overlapping a portion of another adjacent shoe (26) when assembled together.

Figure 11:
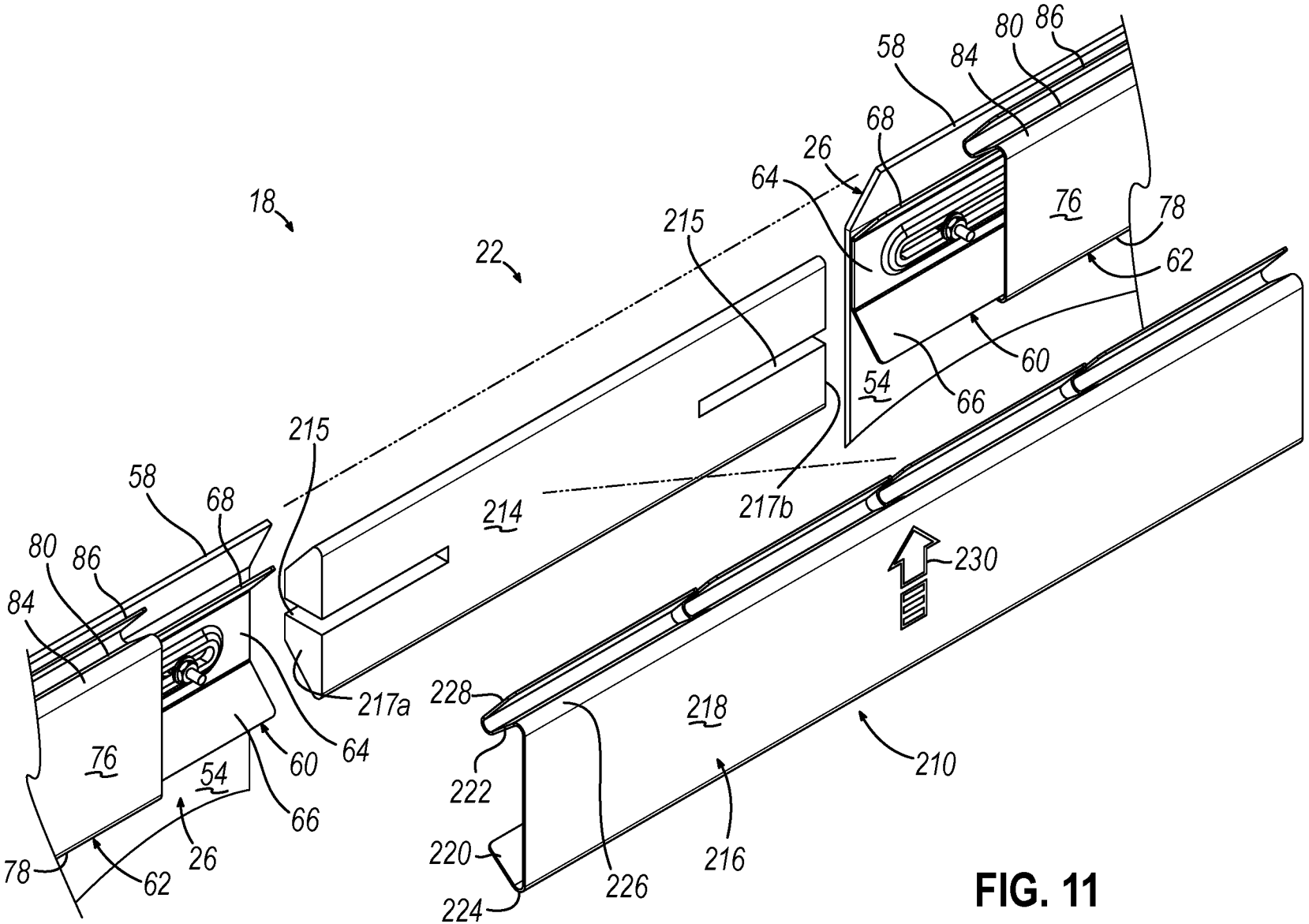
FIG. 11 depicts an enlarged, partially exploded, perspective view of the bridge coupling of FIG. 10 the bridge member removed from the bridge securement clips.

With respect to FIGS. 10-11, bridge coupling (210) of the present example includes a bridge member (214) and a bridge securement (216), which is more particularly a bridge securement clip (216). Bridge member (214) is sized and shaped to be received between leftward barrier securement clip (62) attached to shoe mount bracket (60) and another rightward barrier securement clip (62) attached to shoe mount bracket (60). Bridge member (214) thus extends between and, in the present example, at least partially overlaps each leftward and rightward shoe (26) to straddle adjustable overlap (212). In the present example, bridge member (214) is formed as a pad, such as a foam pad, and generally fluid sealed therethrough to inhibit passage of petroleum product vapors through bridge member (214). Bridge member (214) as the foam pad in the present example is compressible and, more particularly, resiliently compressible so as to resiliently return to a predetermined size and shape for sealing against adjacent surfaces. Furthermore, in one example, bridge member (214) includes a pair of slots (215) extending toward a center portion of bridge member (214) respectively from left and right ends (217*a*, 217*b*) of bridge member (214). Such slots (215) provide clearance for fasteners (74) against base plate (64) such that fasteners (74) are received in slots (215) upon assembly.

Bridge securement clip (216) as shown in FIGS. 10-11 is similarly shaped to barrier securement clip (62) but is larger in the present example to be resiliently clipped onto leftward and rightward barrier securement clips (62) and over bridge member (214). More particularly, bridge securement clip (216) is free of fasteners extending therethrough and configured to releasably affix to leftward and rightward barrier securement clips (62) and bridge member (214) by resiliently clipping thereon. Specifically, bridge securement clip (216) has a bridge plate (218), a lower bridge catch (220), and an upper bridge catch (222). Bridge plate (218) extends generally in the vertical direction, whereas lower bridge catch (220) extends downward therefrom and radially outward at an angle relative to bridge plate (218) toward base plate (64). In contrast, upper bridge catch (222) extends upward from bridge plate (218), but also radially outward at an angle relative to bridge plate (218) toward base plate (64). In the present example, lower and upper bridge catches (220, 222) are in the form of flanges extending along bridge plate (218). Each bridge plate (218) has a plurality of such lower bridge catches (220) at least partially separated by gaps. Similarly, each bridge plate (218) has a plurality of such upper bridge catches (222) at least partially separated by gaps. Such gaps may provide for greater deflection and/or flexibility along bridge securement clip (216) for ease of installation and/or removal from barrier securement clips (262) and/or bridge member (214). Alternative examples of bridge securement clip (216) may be free of such gaps, such that the invention is not intended to be unnecessarily limited to the particular arrangement of lower and upper bridge catches (220, 222) as shown and described herein.

Lower and upper bridge catches (220, 222) extend from bridge plate (218) and are resiliently biased relative to bridge plate (218) to a clamp position as shown in FIGS. 10-12A. To this end, bridge securement clip (216) of the present example further includes a lower resilient portion (224) extending at least partially between lower bridge catch (220) and bridge plate (218) as well as an upper resilient portion (226) extending at least partially between upper bridge catch (220) and bridge plate (218). Lower and upper bridge catches (220, 222) are thus each configured to deflect relative to bridge plate (218) from respective clamp positions to unclamped positions, which may also be referred to herein as installation positions. In this respect either one or both of lower and upper bridge catches (220, 222) deflected to the unclamped position effectively increases an open distance between lower and upper bridge catches (220, 222) so that each of lower and upper bridge catches (220, 222) sufficiently clears bridge member (214) as well as lower and upper barrier catches (78, 80) of barrier securement clip (62) for being received on barrier securement clip (62) or removed from barrier securement clip (62). As shown in the present example, lower and upper bridge catches (220, 222) effectively clamp onto lower and upper barrier catches (78, 80) of barrier securement clip (62) so that lower and upper barrier catches (78, 80) of barrier securement clip (62) are nested within lower and upper bridge catches (220, 222) when attached thereto. In another example, lower and upper barrier catches (78, 80) may clamp onto another portion of barrier securement clip (62) such that the invention is not intended to be unnecessarily limited to clamping lower and upper bridge catches (220, 222) directly over portions of lower and upper barrier catches (78, 80).

In addition, bridge securement clip (216) of the present example further includes a grip tab (228) similar in at least some respects to grip tab (86) (see FIG. 7A) and extending upward and radially inward from upper bridge catch (220). Grip tab (228) is configured to be selectively manipulated by a technician to generate a moment about upper resilient portion (226) to deflect upper resilient portion (226) and thereby selectively move upper bridge catch (220) from the clamp position toward the unclamped, installation position. Alternatively or in addition, another grip tab (228) may similarly extend from lower bridge catch (220) for similar manipulation. The invention is thus not intended to be unnecessarily limited to the particular grip tab (228) shown in the present example. An arrow (230) may also be included on bridge securement clip (216) to indicate an upward and desired direction of installation for such lower and upper directions, although it will be appreciated that arrow (230) may not be included in one or more examples.

Figure 12C:
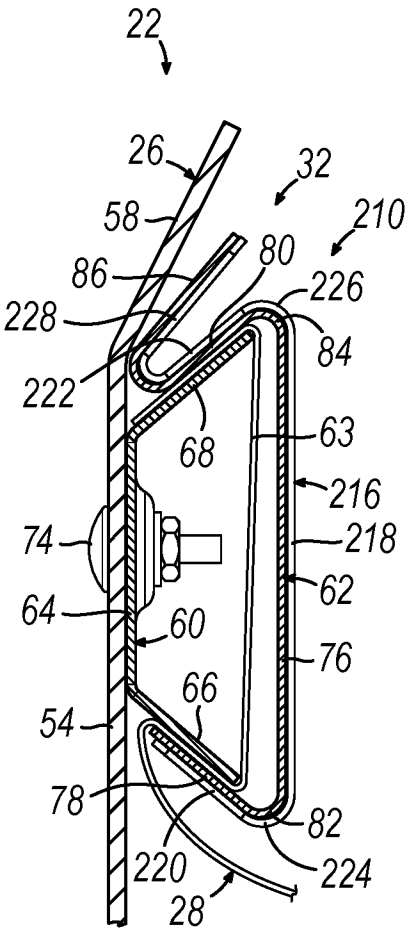
FIG. 12C depicts a cross-sectional view of the outer coupling assembly similar to FIG. 12B, but showing the resilient portion of the barrier securement clip selectively released from the installation position to a clamp position for securing the vapor barrier fabric to the pair of shoes while slidably securing the pair of shoes together.
Figure 12B:
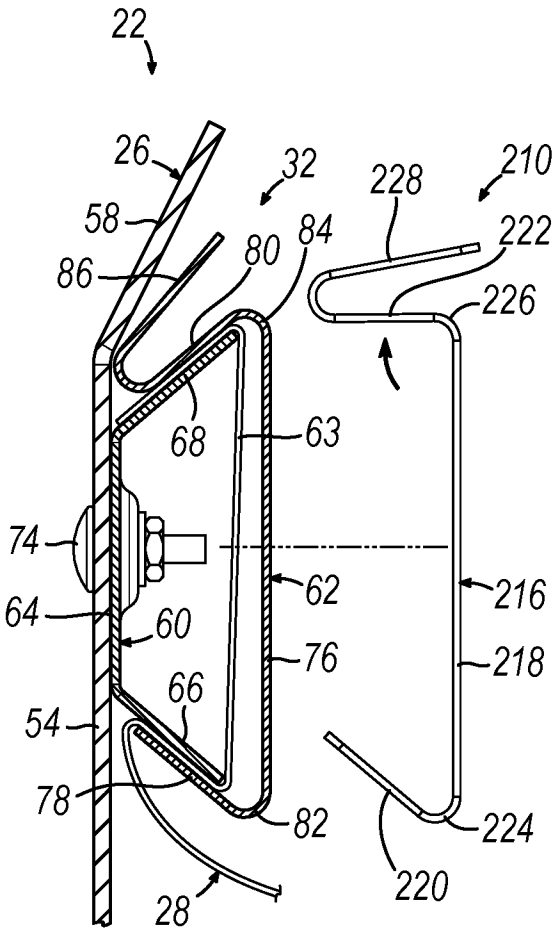
FIG. 12B depicts a cross-sectional view of the outer coupling assembly similar to FIG. 12A, but showing a resilient portion of the bridge securement clip selectively deflected to an installation position for being received on the pair barrier securement clips.
Figure 12A:
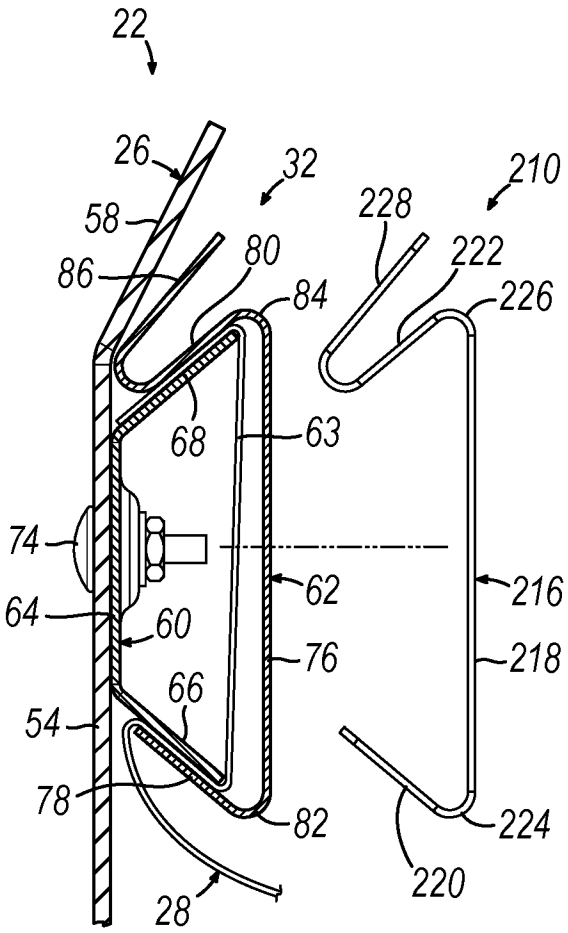
FIG. 12A depicts a cross-sectional view of the outer coupling assembly of FIG. 10 taken along section line 12A-12A of FIG. 10 with the bridge securement clip and the pair barrier securement clips in a disassembled state.

In use, FIGS. 12A-12C show installation of bridge securement clip (216) onto barrier securement clip (62) for securement of vapor barrier fabric (28) to pairs of shoes (26) across adjustable overlap (212) (see FIG. 10). Bridge securement clip (216) is brought proximate to barrier securement clip (62) with outer edge portion (63) of vapor barrier fabric (28) clamped against lower and upper lips (66, 68) via lower and upper barrier catches (78, 80). Technician manipulates grip tab (228) clockwise back toward bridge plate (218) so as to deflect upper resilient portion (226) and move upper bridge catch (222) relative to bridge plate (218) from the clamp position shown in FIG. 12A to the installation position shown in FIG. 12B. At leftward and rightward end portions of bridge securement clip (216), lower bridge catch (220) is then effectively hooked around lower barrier catch (78) and upper bridge catch (222) is moved toward upper barrier catch (80) such that lower and upper barrier catches (78, 80) are vertically between lower and upper bridge catches (220, 222). Similarly, at a central portion of bridge securement clip (216) horizontally between leftward and rightward end portions of bridge securement clip (216), lower bridge catch (220) is also effectively hooked around a lower portion of bridge member (214) and upper bridge catch (222) is moved toward an upper portion of bridge member (214). In turn, upper and lower portions of bridge member (214) are vertically between lower and upper bridge catches (220, 222) such that outer edge portion (63) of vapor barrier fabric (28) is positioned directly between bridge securement clip (216) and bridge member (214) within a channel (234) (see FIGS. 13A-13C) discussed below in greater detail.

Technician then releases grip tab (228) to resiliently return upper bridge catch (222) to the clamp position shown in FIG. 12C such that upper bridge catch (222) resiliently compresses against upper barrier catch (80) at leftward and rightward end portions of bridge securement clip (216) while also compressing against outer edge portion (63) of vapor barrier fabric (28) at the central portion of bridge securement clip (216). In turn, lower bridge catch (220) resiliently compresses against lower barrier catch (78) at leftward and rightward end portions of bridge securement clip (216) while also compressing against outer edge portion (63) of vapor barrier fabric (28) at the central portion of bridge securement clip (216). Fluid sealing of outer edge portion (63) of vapor barrier fabric (28) is thereby formed against each of lower and upper bridge catches (220, 222), such as between lower and upper bridge catches (220, 222) and bridge member (214). Bridge securement clip (216) is sized and shaped relative to bridge member (214) and barrier securement clips (62) such that lower and upper bridge catches (220, 222) are resiliently held in compression toward bridge member (214) against lower and upper barrier catches (66, 68) at leftward and rightward end portions of bridge securement clip (216) and against outer edge portion (63) of vapor barrier fabric (28) at the central portion of bridge securement clip (216) during use.

Figure 13C:
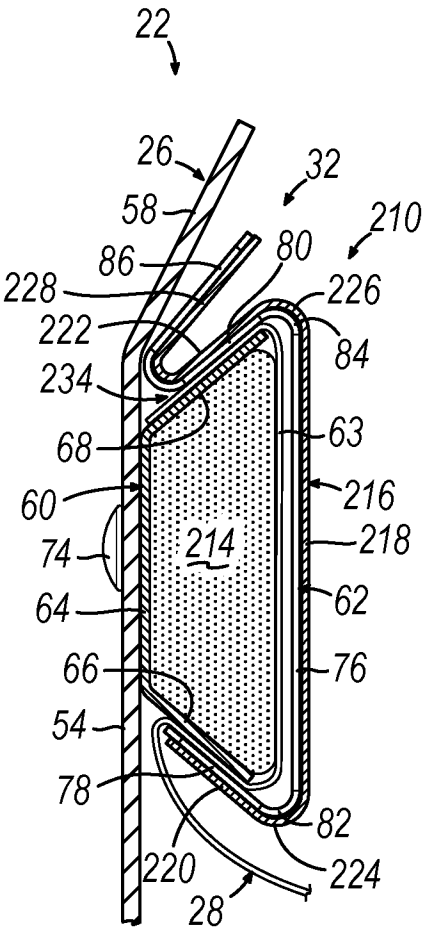
FIG. 13C depicts a cross-sectional view of the outer coupling assembly similar to FIG. 13B, but showing the resilient portion of the barrier securement clip selectively released from the installation position to the clamp position for securing the vapor barrier fabric to the pair of shoes while slidably securing the pair of shoes together at the bridge member.
Figure 13B:
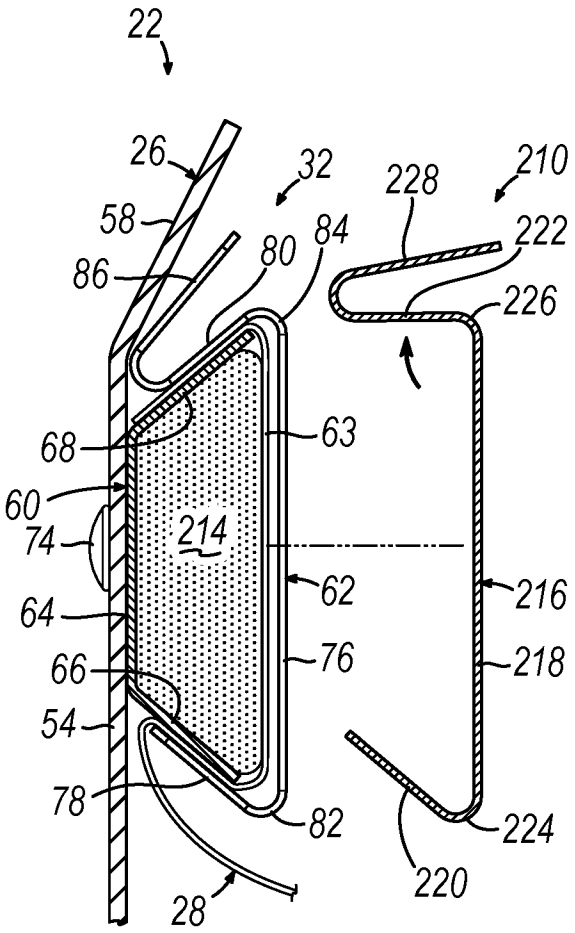
FIG. 13B depicts a cross-sectional view of the outer coupling assembly similar to FIG. 13A, but showing the resilient portion of the bridge securement clip selectively deflected to the installation position for being received on the pair barrier securement clips and the bridge member.
Figure 13A:
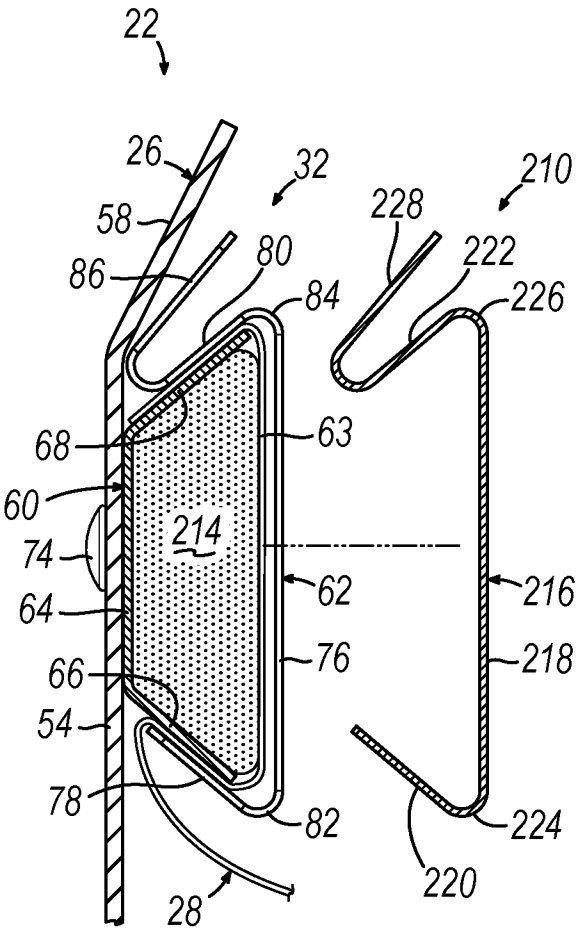
FIG. 13A depicts a cross-sectional view of the outer coupling assembly of FIG. 10 taken along section line 13A-13A of FIG. 10 with the bridge securement clip and the pair barrier securement clips in a disassembled state with the bridge member.

Whereas FIGS. 12A-12C more particularly show installation of the rightward end portion of bridge securement clip (216), FIGS. 13A-13C show installation of the central portion of bridge securement clip (216). While similar in many respects, FIGS. 13A-13C more particularly show horizontally extending channel (234) between bridge securement clip (216) and portions of shoe mount bracket (60) and bridge member (214). Slots (215) (see FIG. 11) of bridge member (214) may receive fasteners (74), such as with a friction fit, to hold bridge member (214) against base plate (64) for ease of assembly with vapor barrier fabric (28). Outer edge portion (63) of vapor barrier fabric (28) is shown received in channel (234), but not shown as filling channel (234) for greater clarity of channel (234). In one example, outer edge portion (63) of vapor barrier fabric (28) may more greatly fill channel (234) in use for greater fluid sealing while accommodating for movement of shoes (26) associated with adjustable overlap (212). Compression of outer edge portion (63) of vapor barrier fabric (28) at leftward and rightward end portions of bridge securement clip (216) is thus greater than compression of outer edge portion (63) of vapor barrier fabric (28) at central portion of bridge securement clip (216) to accommodate changes in adjustable overlap (212).

Figure 14A:
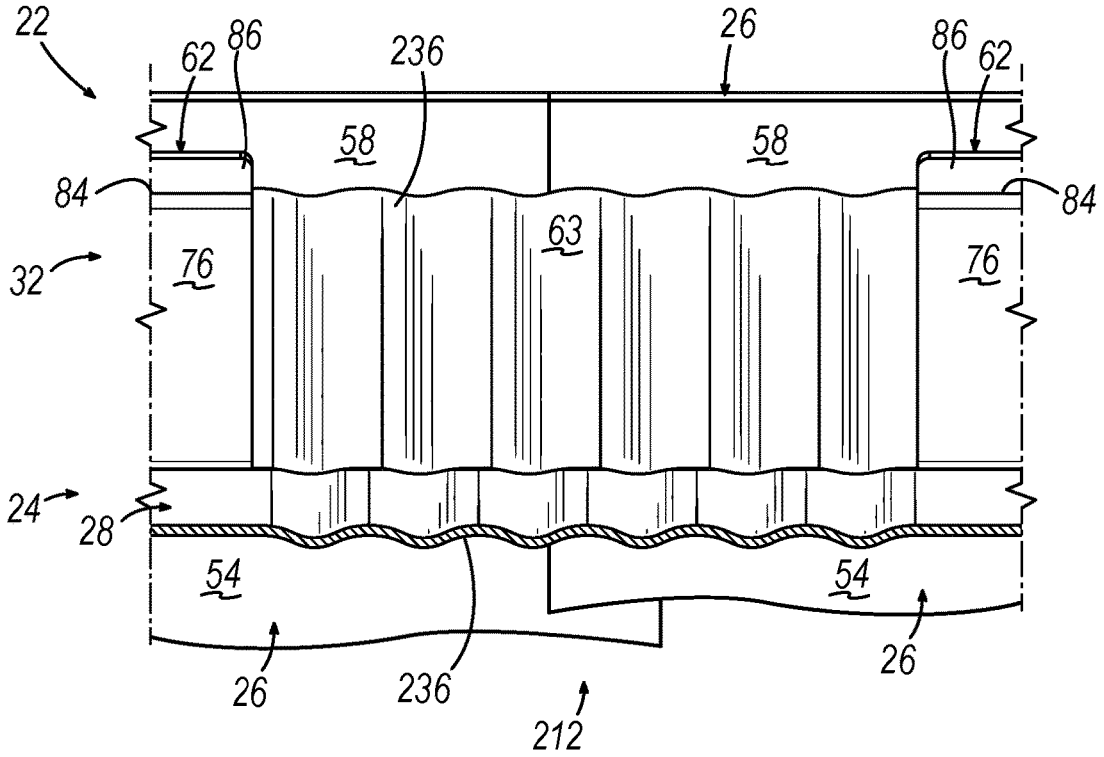
FIG. 14A depicts the outer coupling of FIG. 9 with the pair of shoes and the vapor barrier fabric, but with the barrier securement clip of FIG. 9 hidden for greater clarity of the pair of shoes in a compact arrangement.
Figure 14B:
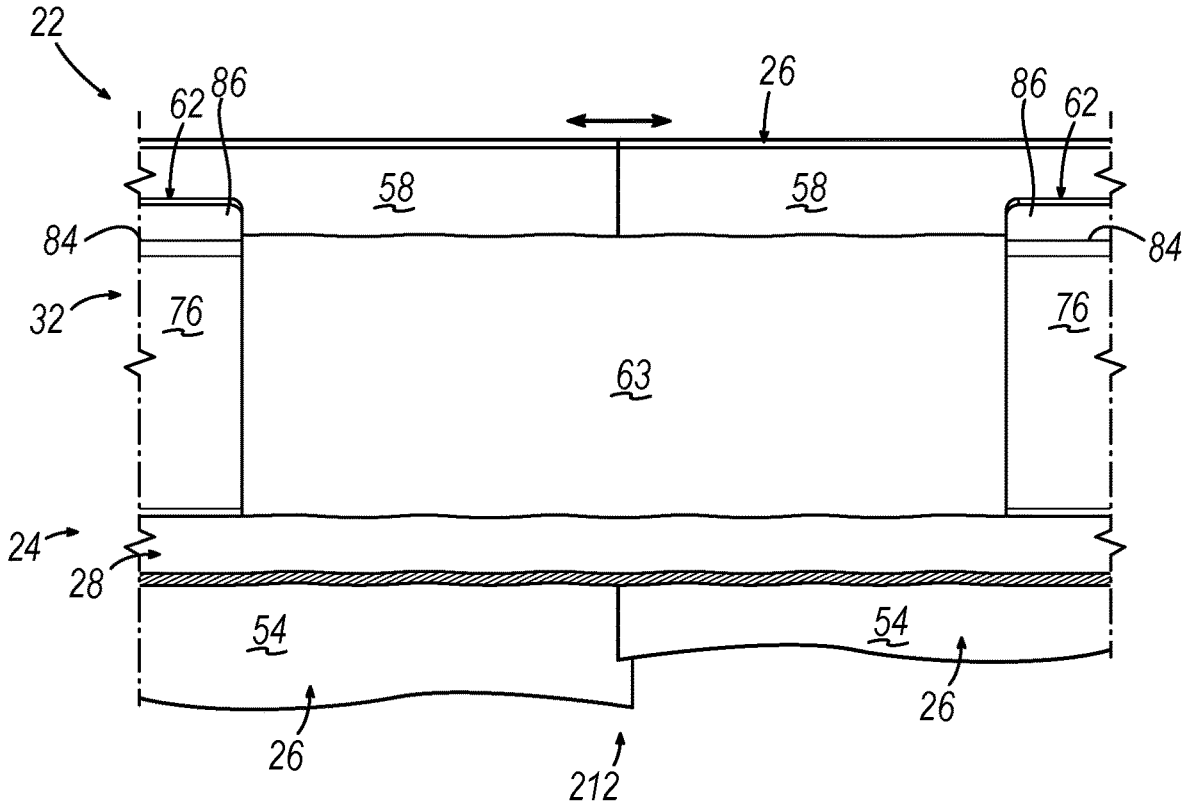
FIG. 14B depicts the outer coupling of FIG. 9 similar to FIG. 14A, but showing the pair of shoes in an extended arrangement.

FIGS. 14A-14B show one example of two shoes (26) moving from a contracted adjustable overlap (212), with greater overlap between adjacent shoes (26), to an expanded adjustable overlap (212), with less overlap between adjacent shoes (26). While shoes (26) are positioned in the contracted adjustable overlap (212), outer edge portion (63) of vapor barrier fabric (28) directly between the central portion of bridge securement clip (216) and bridge member (214) (see FIG. 10) collects in or more bunches of fabric slack (236). In contrast, while shoes (26) are positioned in the expanded adjustable overlap (212), fabric slack (236) of outer edge portion (63) directly between the central portion of bridge securement clip (216) and bridge member (214) (see FIG. 10) spreads apart to accommodate this movement of shoes (26). Channel (234) (see FIGS. 13A-13C) is thus small enough to provide for at least some sealing of outer edge portion (63) of vapor barrier fabric (28) while being large enough to provide for movement and fabric slack (236) and inhibit damage to outer edge portion (63) of vapor barrier fabric (28).

While the above description of installation of bridge securement clip (216) onto bridge member (214) (see FIG. 10) applies to one such bridge securement clip (216) and bridge member (214) (see FIG. 10), this method of installation may then be repeated for each additional bridge securement clip (216) and bridge member (214) (see FIG. 10) at adjustable overlaps (212) about an entire circumference of outer edge portion (63) of vapor barrier fabric (28) until vapor barrier fabric (28) is attached to shoe assembly (24) as desired.

II. Exemplary Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A storage system for a petroleum product, comprising: (a) a floating roof seal, including: (i) a vapor barrier having a flexible material and configured to extend from a first shoe plate to a floating roof, wherein the vapor barrier has a first barrier portion configured to be clamped, and (ii) a first coupling assembly, including: (A) a first shoe mount bracket configured to be secured to the first shoe plate, and (B) a first barrier securement having a first securement body and a first resilient portion, wherein the first resilient portion is biased toward a first clamp position and configured to selectively deflect relative to the first securement body from the first clamp position to a first installation position, wherein the first barrier securement with the first resilient portion in the first installation position is configured to be received on the first shoe mount bracket such that the first barrier portion is positioned between the first barrier securement and the first shoe mount bracket, and wherein the first barrier securement with the first resilient portion in the first clamp position is configured to compress the first barrier portion against the first shoe mount bracket thereby fluidly sealing the first barrier portion between the first shoe mount bracket and the first barrier securement.

Example 2

The storage system of Example 1, wherein the first barrier portion of the vapor barrier is free of holes.

Example 3

The storage system of any one or more of Examples 1 through 2, wherein the first shoe mount bracket includes a first lip, wherein the first barrier securement includes a first catch, and wherein the first catch is configured to hook about the first lip and overlap thereby at least partially securing the first barrier securement to the first shoe mount bracket.

Example 4

The storage system of Example 3, wherein the first barrier portion is configured to be received between the first catch and the first lip and compressed therebetween.

Example 5

The storage system of any one or more of Examples 3 through 4, wherein the first shoe mount bracket includes a second lip, wherein the first barrier securement includes a second catch, and wherein the second catch is configured to hook about the second lip and overlap thereby further secure the first barrier securement to the first shoe mount bracket.

Example 6

The storage system of Example 5, wherein the first barrier portion is configured to be received between the first catch and the first lip and compressed therebetween, and wherein the first barrier portion is further configured to be received between the second catch and the second lip and compressed therebetween.

Example 7

The storage system of any one or more of Examples 5 through 6, wherein the first lip is vertically opposite from the second lip in a vertical direction, wherein the first catch is vertically opposite from the second catch in the vertical direction, wherein the first catch is configured to radially overlap with the first lip in a radial direction, wherein the second catch is configured to radially overlaps with the second lip in the radial direction, and wherein the radial direction is perpendicular to the vertical direction.

Example 8

The storage system of any one or more of Examples 5 through 7, wherein the first catch projects from the first securement body, wherein the second catch projects from the first securement body, and wherein at least a portion of the first resilient portion is positioned between the first catch and the first securement body such that the first catch is configured to selectively move relative to the second catch between the first installation position and first clamp position.

Example 9

The storage system of Example 8, wherein the first barrier securement further includes a grip tab extending from the first catch, wherein the grip tab is configured to be selectively manipulated to thereby selectively move the first catch and deflect the first resilient portion from the first clamp position toward the first installation position.

Example 10

The storage system of any one or more of Examples 1 through 9, wherein the floating roof seal further includes a first shoe plate configured to engage a tank wall.

Example 11

The storage system of Example 10, wherein the floating roof seal further includes a hanger configured to connect to each of the first shoe plate and the floating roof.

Example 12

The storage system of Example 11, further comprising a floating roof, wherein the floating roof seal further includes a second coupling assembly configured to connect the vapor barrier to the floating roof.

Example 13

The storage system of Example 12, further comprising a tank body configured to receive the floating roof such that the floating roof is operatively connected to the tank body via the floating roof seal.

Example 14

The storage system of any one or more of Examples 10 through 13, wherein the floating roof seal further includes: (i) a second shoe plate configured to engage the tank wall, (ii) the vapor barrier having second barrier portion configured to be clamped, (iii) the first coupling assembly, further including: (A) a second shoe mount bracket configured to be secured to the second shoe plate, (B) a second barrier securement having a second securement body and a second resilient portion, wherein the second resilient portion is biased toward a second clamp position and configured to selectively deflect relative to the second securement body from the second clamp position to a second installation position, wherein the second barrier securement with the second resilient portion in the second installation position is configured to be received on the second shoe mount bracket such that the second barrier portion is positioned between the second barrier securement and the second shoe mount bracket, and wherein the second barrier securement with the second resilient portion in the second clamp position is configured to compress second barrier portion against the second shoe mount bracket thereby fluidly sealing the second barrier portion between the second shoe mount bracket and the second barrier securement, and (C) a bridge coupling configured to connect to each of the first and second barrier securements to thereby movably secure the first shoe plate relative to the second shoe plate.

Example 15

The storage system of Example 14, wherein the bridge coupling includes a bridge member and a bridge securement, wherein the bridge member is configured to be slidably received within each of the first and second barrier securements, and wherein the bridge securement is configured to resilient clamp onto each of the first barrier securement, the second barrier securement, and the bridge member such that the first shoe plate is slidable relative to the second shoe plate for accommodating movement of first and second shoe plates during use.

Example 16

A floating roof seal, comprising: (a) a first shoe plate configured to engage a tank wall; (b) a vapor barrier having a flexible material and a first barrier portion configured to be clamped; and (c) a first coupling assembly including a first barrier securement having a first securement body and a first resilient portion, wherein the first resilient portion is biased toward a first clamp position and configured to selectively deflect relative to the first securement body from the first clamp position to a first installation position, wherein the first barrier securement with the first resilient portion in the first installation position is configured to be unclamped from the vapor barrier for positioning of the vapor barrier relative to the first shoe plate, wherein the first barrier securement with the first resilient portion in the first clamp position compresses against the vapor barrier thereby fluidly sealing the first barrier securement against the first barrier portion without inserting a fastener through the first barrier portion of the vapor barrier.

Example 17

The floating roof seal of Example 16, wherein the first barrier portion is free of holes.

Example 18

A method of sealing a floating roof seal for storage of a petroleum product, comprising: (a) deflecting a first resilient portion of a first barrier securement relative to a first securement body of the first barrier securement from a first clamp position to a first installation position, wherein the first resilient portion is biased toward the first clamp position; (b) positioning a first barrier portion of a vapor barrier between the first barrier securement and a first shoe plate, wherein the first shoe plate is configured to engage a tank wall; and (c) releasing the first resilient portion of the first barrier securement such that the first barrier securement compresses against the first barrier portion of the vapor barrier thereby fluidly sealing the first barrier securement against the first barrier portion of the vapor barrier for at least partially sealing the floating roof seal for storage of the petroleum product.

Example 19

The method of claim 18, further comprising: (a) deflecting a second resilient portion of a second barrier securement relative to a second securement body of the second barrier securement from a second clamp position to a second installation position, wherein the second resilient portion is biased toward the second clamp position; (b) positioning a second barrier portion of the vapor barrier between the second barrier securement and a second shoe plate, wherein the second shoe plate is configured to engage the tank wall; (c) releasing the second resilient portion of the second barrier securement such that the second barrier securement compresses against the second barrier portion of the vapor barrier thereby fluidly sealing the second barrier securement against the second barrier portion of the vapor barrier for at least partially sealing the floating roof seal for storage of the petroleum product; and (d) movably connecting the first shoe plate relative to the second shoe plate with a bridge coupling, wherein the bridge coupling fluidly seals against a third barrier portion of the vapor barrier extending between the first and second barrier portions.

Example 20

The method of Example 19, wherein each of the first, second, and third barrier portions of the vapor barrier are free of fasteners extending therethrough.

Example 21

A storage system for a petroleum product, comprising: (a) a floating roof seal, including: (i) a vapor barrier having a flexible material and configured to extend from a first shoe plate to a floating roof and further extend from a second shoe plate to the floating roof, wherein the vapor barrier has a barrier portion configured to be clamped, and (ii) a coupling assembly, including: a bridge coupling, wherein the bridge coupling is configured to extend from the first shoe plate to the second shoe plate and movably secure the barrier portion relative to each of the first and second shoe plate.

III. Miscellaneous

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention.

Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A storage system for a petroleum product, comprising:

(a) a floating roof seal, including:

(i) a vapor barrier having a flexible material and configured to extend from a first shoe plate to a floating roof, wherein the vapor barrier has a first barrier portion configured to be clamped, and (ii) a first coupling assembly, including:

(A) a first shoe mount bracket configured to be secured to the first shoe plate, and (B) a first barrier securement having a first securement body and a first resilient portion, wherein the first resilient portion is biased toward a first clamp position and configured to selectively deflect relative to the first securement body from the first clamp position to a first installation position, wherein the first barrier securement with the first resilient portion in the first installation position is configured to be received on the first shoe mount bracket such that the first barrier portion is positioned between the first barrier securement and the first shoe mount bracket, and wherein the first barrier securement with the first resilient portion in the first clamp position is configured to compress the first barrier portion against the first shoe mount bracket thereby fluidly sealing the first barrier portion between the first shoe mount bracket and the first barrier securement.

2. The storage system of claim 1, wherein the first barrier portion of the vapor barrier is free of holes.

3. The storage system of claim 1, wherein the first shoe mount bracket includes a first lip, wherein the first barrier securement includes a first catch, and wherein the first catch is configured to hook about the first lip and overlap thereby at least partially securing the first barrier securement to the first shoe mount bracket.

4. The storage system of claim 3, wherein the first barrier portion is configured to be received between the first catch and the first lip and compressed therebetween.

5. The storage system of claim 3, wherein the first shoe mount bracket includes a second lip, wherein the first barrier securement includes a second catch, and wherein the second catch is configured to hook about the second lip and overlap thereby further secure the first barrier securement to the first shoe mount bracket.

6. The storage system of claim 5, wherein the first barrier portion is configured to be received between the first catch and the first lip and compressed therebetween, and wherein the first barrier portion is further configured to be received between the second catch and the second lip and compressed therebetween.

7. The storage system of claim 5, wherein the first lip is vertically opposite from the second lip in a vertical direction, wherein the first catch is vertically opposite from the second catch in the vertical direction, wherein the first catch is configured to radially overlap with the first lip in a radial direction, wherein the second catch is configured to radially overlaps with the second lip in the radial direction, and wherein the radial direction is perpendicular to the vertical direction.

8. The storage system of claim 5, wherein the first catch projects from the first securement body, wherein the second catch projects from the first securement body, and wherein at least a portion of the first resilient portion is positioned between the first catch and the first securement body such that the first catch is configured to selectively move relative to the second catch between the first installation position and first clamp position.

9. The storage system of claim 8, wherein the first barrier securement further includes a grip tab extending from the first catch, wherein the grip tab is configured to be selectively manipulated to thereby selectively move the first catch and deflect the first resilient portion from the first clamp position toward the first installation position.

10. The storage system of claim 1, wherein the floating roof seal further includes a first shoe plate configured to engage a tank wall.

11. The storage system of claim 10, wherein the floating roof seal further includes a hanger configured to connect to each of the first shoe plate and the floating roof.

12. The storage system of claim 11, further comprising a floating roof, wherein the floating roof seal further includes a second coupling assembly configured to connect the vapor barrier to the floating roof.

13. The storage system of claim 12, further comprising a tank body configured to receive the floating roof such that the floating roof is operatively connected to the tank body via the floating roof seal.

14. The storage system of claim 10, wherein the floating roof seal further includes:

(i) a second shoe plate configured to engage the tank wall, (ii) the vapor barrier having second barrier portion configured to be clamped, (iii) the first coupling assembly, further including:

(A) a second shoe mount bracket configured to be secured to the second shoe plate, (B) a second barrier securement having a second securement body and a second resilient portion, wherein the second resilient portion is biased toward a second clamp position and configured to selectively deflect relative to the second securement body from the second clamp position to a second installation position, wherein the second barrier securement with the second resilient portion in the second installation position is configured to be received on the second shoe mount bracket such that the second barrier portion is positioned between the second barrier securement and the second shoe mount bracket, and wherein the second barrier securement with the second resilient portion in the second clamp position is configured to compress second barrier portion against the second shoe mount bracket thereby fluidly sealing the second barrier portion between the second shoe mount bracket and the second barrier securement, and (C) a bridge coupling configured to connect to each of the first and second barrier securements to thereby movably secure the first shoe plate relative to the second shoe plate.

15. The storage system of claim 14, wherein the bridge coupling includes a bridge member and a bridge securement, wherein the bridge member is configured to be slidably received within each of the first and second barrier securements, and wherein the bridge securement is configured to resilient clamp onto each of the first barrier securement, the second barrier securement, and the bridge member such that the first shoe plate is slidable relative to the second shoe plate for accommodating movement of first and second shoe plates during use.

16. A floating roof seal, comprising:

(a) a first shoe plate configured to engage a tank wall;

(b) a vapor barrier having a flexible material and a first barrier portion configured to be clamped; and (c) a first coupling assembly including a first barrier securement having a first securement body and a first resilient portion, wherein the first resilient portion is biased toward a first clamp position and configured to selectively deflect relative to the first securement body from the first clamp position to a first installation position, wherein the first barrier securement with the first resilient portion in the first installation position is configured to be unclamped from the vapor barrier for positioning of the vapor barrier relative to the first shoe plate, wherein the first barrier securement with the first resilient portion in the first clamp position compresses against the vapor barrier thereby fluidly sealing the first barrier securement against the first barrier portion without inserting a fastener through the first barrier portion of the vapor barrier.

17. The floating roof seal of claim 16, wherein the first barrier portion is free of holes.

* * * * *